US011152738B2

(12) United States Patent
Tiemann et al.

(10) Patent No.: US 11,152,738 B2
(45) Date of Patent: Oct. 19, 2021

(54) HOLDING FRAME FOR AN INDUSTRIAL, ELECTRICAL CONNECTOR

(71) Applicant: HARTING ELECTRIC GMBH & CO. KG, Espelkamp (DE)

(72) Inventors: Andre Tiemann, Bad Essen (DE); Heiko Meier, Minden (DE); Mirko Mossig, Bielefeld (DE); Michael Przyborowski, Bielefeld (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/755,064

(22) PCT Filed: Oct. 15, 2018

(86) PCT No.: PCT/DE2018/100844

§ 371 (c)(1),
(2) Date: Apr. 9, 2020

(87) PCT Pub. No.: WO2019/080963

PCT Pub. Date: May 2, 2019

(65) Prior Publication Data

US 2020/0295500 A1 Sep. 17, 2020

(30) Foreign Application Priority Data

Oct. 23, 2017 (DE) ..... 10 2017 124 632.0

(51) Int. Cl.
*H01R 24/00* (2011.01)
*H01R 13/518* (2006.01)
*H01R 13/514* (2006.01)

(52) U.S. Cl.
CPC ..... *H01R 13/518* (2013.01); *H01R 13/514* (2013.01)

(58) Field of Classification Search
CPC ... H01R 13/514; H01R 13/516; H01R 13/518
USPC ..... 439/660, 701
See application file for complete search history.

(56) References Cited

U.S. PATENT DOCUMENTS

| | | | |
|---|---|---|---|
| 4,768,964 | A | 9/1988 | Zucchini |
| 6,004,162 | A | 12/1999 | Harting et al. |
| 2003/0194914 | A1 | 10/2003 | Duck et al. |
| 2007/0155252 | A1 | 7/2007 | Ferderer |
| 2008/0090432 | A1 | 4/2008 | Patterson et al. |

(Continued)

FOREIGN PATENT DOCUMENTS

| | | | |
|---|---|---|---|
| CN | 201656115 | U | 11/2010 |
| CN | 202275743 | U | 6/2012 |

(Continued)

OTHER PUBLICATIONS

Russian Office Action dated Nov. 18, 2020, for Russian Application No. 2020114505/07 (024145), 3 pages.

(Continued)

*Primary Examiner* — Khiem M Nguyen
(74) *Attorney, Agent, or Firm* — Seed IP Law Group LLP

(57) ABSTRACT

A holding frame for an industrial electrical connector for holding similar and/or different electrical connector modules is provided, the holding frame consisting largely of a three-dimensionally bent wire frame. Such a holding frame can be produced particularly economically. The holding frame is used in particular in applications in which particularly high mechanical stability is not required.

9 Claims, 2 Drawing Sheets

(56) References Cited

U.S. PATENT DOCUMENTS

| | | | |
|---|---|---|---|
| 2016/0093980 | A1 | 3/2016 | Beischer et al. |
| 2016/0276778 | A1 | 9/2016 | Beischer et al. |
| 2016/0285194 | A1 | 9/2016 | Herbrechtsmeier |
| 2018/0254578 | A1 | 9/2018 | Herbrechtsmeier et al. |
| 2019/0036268 | A1 | 1/2019 | Schönfeld et al. |

FOREIGN PATENT DOCUMENTS

| | | | |
|---|---|---|---|
| CN | 204045824 | U | 12/2014 |
| CN | 105814748 | A | 7/2016 |
| CN | 206098894 | U | 4/2017 |
| DE | 29 601 998 | U1 | 4/1996 |
| DE | 20 2011 050 643 | U1 | 10/2011 |
| DE | 20 2013 103 611 | U1 | 11/2013 |
| DE | 10 2012 107 270 | A1 | 2/2014 |
| DE | 10 2012 110 907 | A1 | 5/2014 |
| DE | 10 2013 106 279 | A1 | 12/2014 |
| DE | 10 2015 104 562 | A1 | 9/2016 |
| DE | 10 2013 113 976 | B4 | 10/2016 |
| DE | 10 2015 114 703 | A1 | 3/2017 |
| EP | 0 860 906 | A2 | 8/1998 |
| EP | 1 026 788 | A1 | 8/2000 |
| EP | 1 353 412 | A2 | 10/2003 |
| EP | 1 801 927 | A1 | 6/2007 |
| EP | 2 510 589 | A1 | 10/2012 |
| EP | 2 510 590 | A1 | 10/2012 |
| EP | 2 917 974 | A1 | 9/2015 |
| EP | 2 979 326 | A1 | 2/2016 |
| EP | 3 067 993 | A1 | 9/2016 |
| FR | 2 781 312 | A3 | 1/2000 |
| JP | 2009-117218 | A | 5/2009 |
| RU | 2 446 529 | C2 | 3/2012 |
| SU | 902125 | A1 | 1/1982 |
| WO | 2017/125107 | A1 | 7/2017 |

OTHER PUBLICATIONS

International Search Report and Written Opinion, dated Jan. 14, 2019, for International Application No. PCT/DE2018/100844, 11 pages, (with English Translation of Search Report).

Chinese Office Action dated Jan. 5, 2021, for Chinese Application No. 201880069201.3, 7 pages.

German Patent Office, Office Action for German application No. 10 2017 124 632.0, dated Aug. 14, 2018, 7 pages.

International Preliminary Report on Patentability, dated Apr. 28, 2020, for International Application No. PCT/DE2018/100844, 8 pages.

HOLDING FRAME FOR AN INDUSTRIAL, ELECTRICAL CONNECTOR

BACKGROUND

Technical Field

This disclosure relates to a holding frame for an industrial connector for accommodating similar and/or different connector modules.

Connector modules of this type are required as a constituent of a modular connector system, in order to permit the flexible adaptation of a connector, specifically a heavy-duty rectangular connector, also known as an industrial connector, to specific requirements for signal and energy transmission, e.g., between two electrical devices. To this end, customarily, connector modules in corresponding holding frames are employed, which are also sometimes described as connector module frames, articulated frames, module frames or modular frames. The function of holding frames is thus the accommodation of a plurality of mutually similar and/or different connector modules, and to fasten the latter securely on a surface and/or in a connector housing or similar structure or device.

In general, each of the connector modules comprises an essentially cuboid insulating body. These insulating bodies can function, for example, as contact carriers, for the accommodation and fixing of a wide variety of contacts. A connector thus constituted is therefore highly flexible in its function. For example, pneumatic modules, optical modules, modules for the transmission of electrical energy and/or of analog and/or digital electrical signals can be accommodated in the respective insulating body, and thus employed in the holding frame. Increasingly, connector modules also assume measuring and data processing functions.

Description of the Related Art

According to the prior art, above-mentioned modular connector systems having connector modules of this type and employing a holding frame of this type, also known as a holding frame, module frame, articulated frame or modular frame, are disclosed in numerous documents and publications, exhibited at trade fairs and extensively employed in the industrial sector in the form of heavy-duty connectors. They are described, for example, in documents DE 10 2013 106 279 A1, DE 10 2012 110 907 A1, DE 10 2012 107 270 A1, DE 20 2013 103 611 U1, EP 2 510 590 A1, EP 2 510 589 A1, DE 20 2011 050 643 U1, EP 0 860 906 A2, DE 29 601 998 U1, EP 1 353 412 A2, DE 10 2015 104 562 A1, EP 3 067 993 A1, EP 1 026 788 A1, EP 2 979 326 A1, EP 2 917 974 A1.

From the above-mentioned publication EP 0 860 906 B1, a holding frame is known in the form of an articulated frame for holding connector modules, for installation in a connector housing or for screw-fitting to wall surfaces. Connector modules are thus employed in the holding frame. Holding means are provided on the connector modules, which cooperate with windows which are provided on opposing lateral parts of the holding frame, wherein the windows are provided by way of cut-outs, which are configured as openings in the lateral parts of the holding frame which are closed on all sides.

Document DE 10 2015 114 703 A1 discloses a further development of a holding frame of this type, configured as an articulated frame. The holding frame disclosed therein comprises at least one fixing means, by means of which the frame halves can be secured in relation to one another in two positions, an open position and a closed position, thereby considerably simplifying handling.

Document DE 20 2013 103 611 U1 discloses two exceptionally stable mutually screwable frame halves, which can be cost-effectively produced by stamping and bending and screwed together, which are appropriate for the accommodation, inter alia, of pneumatic modules. The holding frame thus assembled shows very limited creep properties, even in response to high long-term mechanical loading. Disadvantageously, however, the addition or replacement of a connector module is extremely complex.

In practice, however, it has been shown that the assembly of holding frames of this type involves a complex operation.

Document EP 1 801 927 B1 discloses a one-piece holding frame, which is comprised of a plastic material. The holding frame is configured as a circumferential collar and, on its plug-in side, comprises a plurality of wall segments which are separated by slots. Two mutually opposing wall segments respectively constitute an insertion region for a connector module, wherein the wall segments incorporate window-like openings, the function of which is to accommodate projections which are molded onto the narrow sides of the module. Moreover, a guide slot is provided in each of the wall segments. The guide slot is constituted above the openings by means of an outwardly offset window bar, which incorporates an insertion chamfer on its inner side. The connector modules additionally incorporate latching arms, acting in the direction of the cable terminals, which are molded onto the narrow sides thereof, and which latch onto the lateral collar wall from below, such that the connector modules are secured in the holding frame by two independent latching means.

Document DE 10 2013 113 976 B4 discloses a holding frame for an industrial connector, for accommodating similar and/or different connector modules. The holding frame is comprised of a base frame of rectangular cross section, having two mutually opposing lateral parts. A flange part, comprised of a flexible material, specifically of a spring-elastic sheet metal, is fitted to each of the lateral parts. Upon the insertion of a connector module into the holding frame, perpendicularly to the plane of the frame, these flange parts are initially bent outwards from the lateral part. Specifically, the flange parts can comprise tabs with latching windows, which are appropriate for the individual latching of the connector modules into the holding frame, at the latching lugs thereof. The connector modules can thus be individually inserted in the holding frame, from the cable terminal direction to the plug-in direction, with only limited complexity, and removed thereafter in the converse direction. The plugged-in connector module, in the plane of the frame, is held in the base frame of the holding frame in a secure and stable manner. In the insertion direction, perpendicularly to the plane of the frame, each of the modules, at their latching lugs, can be latched between two mutually opposing tabs. This design provides a fundamental advantage, in that the connector modules can be individually inserted and removed, without compromising the attachment of the remaining modules. This design further permits the holding frame to be constituted of metal, thus permitting the above-mentioned protective grounding.

In principle, the modules in known holding frames of this type further incorporate an element of "play", i.e., they are retained in the holding frame with a specific mechanical tolerance. From a technical viewpoint, at least to a certain degree, this is considered necessary for the majority of applications, as this arrangement, during the plugging-in process, permits the equalization of corresponding tolerances vis-à-vis the mating connector. However, in the event of an excessive tolerance, as may occasionally be observed the last-mentioned instance of the prior art, the attachment of the connector modules by means of the above-mentioned flange parts may not be sufficient to meet the requirements of certain industrial sectors. In practice, excessive play within the base component of the holding frame can frequently result in excessively high plug-in and extraction forces during the mating and separation of connectors and mating connectors. Moreover, the contact elements, for example during the plugging-in process, can thus be tilted, as a result of which increased abrasion occurs, which can even result, over time, in an overvoltage arcing hazard. Also, from a data processing viewpoint, the above-mentioned play may also be disadvantageous for the employment of specific data processing connector modules, as this tolerance may substantially handicap an electronic bus connection.

All the above-mentioned holding frames are designed for multiple fitting and, in some cases, for the fitting of different connector modules. Holding frames are therefore required to possess a degree of mechanical stability, together with an element of durability in their locking means for connector modules.

If a holding frame is intended to be fitted with connector modules only a few times, or even only once, holding frames from the prior art are, firstly, excessively complex in their operation, and secondly are technically over-dimensioned, and thus too expensive.

BRIEF SUMMARY

Embodiments of the present invention provide a holding frame which can be simply fitted with connector modules, and is simultaneously cost-effective to produce.

The holding frame according to embodiments of the present invention is intended for use in industrial connectors, also described as heavy-duty connectors, which are specifically appropriate for the transmission of high electric currents. In the holding frame, similar and/or different connector modules can be employed in a reversible manner. Accordingly, an industrial connector, depending upon the field of application and the requirements of the customer, can be differently constituted. According to an embodiment of the invention, the holding frame is essentially comprised of or essentially consists of a three-dimensionally bent wire frame.

Advantageously, the wire frame may be comprised of a single and continuous piece of wire. A piece of wire of a specific length is formed into the required three-dimensional shape by one or more bending machines. The wire material is inexpensive, and the manufacturing process can be executed cost-effectively, such that a holding frame according to embodiments of the invention can be produced economically. The piece of wire can be cut to the desired length from a roll of wire.

The wire frame is preferably constituted of a wire, the diameter of which is at least in regions of at least 1 millimeter, up to a maximum of 2 millimeters. The resulting wire frame is thus provided with a degree of mechanical stability.

The wire is advantageously comprised of a conductive metallic material. The material is preferably flexible and resilient.

The wire frame preferably comprises a frame-like base structure, having two mutually opposing end surfaces and two mutually opposing lateral surfaces. In this context, the term "surfaces" is not to be understood literally. Sections of the wire frame arranged in one plane are described here as surfaces, in the interests of simplicity. The lateral surfaces respectively comprise fixing contours, which are essentially constituted by zonally tapering wire loops. At the closed end of the respective fixing contours, recesses are constituted by tapering, in which the latching lugs of connector modules can be accommodated.

The latching lugs of the connector modules can reach the recesses of the fixing contours in various ways. The connector modules are generally inserted from the direction of the closed end of the fixing contour (i.e., the terminal side) into the holding frame. The opposing fixing contours of the connector module are initially compressed outwards—perpendicularly to the lateral surfaces. The fixing contours are then reset by a restoring force, and the recesses located at the end of the fixing contours engage over the latching lugs of the connector modules. The connector modules are reversibly secured in the holding frame accordingly.

If the connector modules are inserted into the holding frame from the direction of the open end of the fixing contour (i.e., the plug-in side), the tapers in the respective fixing contour are initially expanded by the respective latching lugs of the connector modules, until said latching lugs are located in the respective recesses of the fixing contours. Thereafter, the taper is restored by the restoring force of the wire material, and the connector modules are secured in the holding frame. The connector modules can be removed from the holding frame, on the plug-in side, in an analogous manner. Optionally, to this end, the geometry of the respective recess in the fixing contour and of the latching lugs of the connector modules can be optimized and mutually tailored, in an expert fashion.

The holding frame according to embodiments of the invention, in some cases, provides a lower mechanical stability than known holding frames. The holding frame disclosed herein, in applications involving a high number of plug-in cycles, may thus provide no advantages over the prior art. Specifically, any use thereof with high plug-in and extraction forces must be carefully considered beforehand. As described above, however, the connector modules can be inserted in, and also removed from both sides of the holding frame. In fields of application in which only a limited number of plug-in cycles are required, the holding frame envisaged here has advantages. The facility for the fitting of components from either side clearly distinguishes the holding frame described here from holding frames which are known from the prior art.

In a particularly advantageous form of embodiment, the wire frame, in its corner regions, respectively comprises a loop, in which a fixing element is held in each case. The fixing element is preferably a screw. The holding frame can thus be reversibly fastened in a connector housing. The loops can be provided in a simple manner, in conjunction with the bending method employed for production.

The holding frame preferably comprises two sidewalls, which are respectively attached to the lateral surfaces of the wire frame. The sidewalls are preferably comprised of plastic, and can thus be manufactured cost-effectively. The sidewalls enhance the overall rigidity of the holding frame. The sidewalls can be simply and reversibly fitted to the wire frame, without the use of tools, using appropriate fixing means or devices.

It is particularly advantageous if the holding frame incorporates a PE-contact element. The PE-contact element permits the protective grounding of the holding frame or of a connector. Naturally, the holding frame must also possess electrically conductive properties and is produced, for example, from an electrically conductive wire.

At one end face, the wire frame preferably incorporates a loop-shaped recess, in which the PE-contact element is held. The loop can be provided in a simple manner, in conjunction with the bending method employed for production.

In a particularly preferred variant of the invention, the PE-contact element comprises a cylindrical contact pin which, in turn, incorporates a circumferential roughened region. By way of this roughened region, the PE-contact element is captively held in the loop which is provided for this purpose.

The roughened region can be thickened, and thus assumes a larger diameter than the remainder of the contact pin. The roughened region is preferably configured with a knurled or sprocket wheel-shaped design. A design of this type can be simply integrated in the manufacturing process of the PE-contact element.

BRIEF DESCRIPTION OF THE SEVERAL VIEWS OF THE DRAWINGS

Exemplary embodiments of the invention are represented in the drawings, and described in greater detail hereinafter. In the drawings.

The figures may include partially simplified schematic representations. In some cases, identical reference numbers are employed for similar, but optionally not identical elements. Different views of the same elements might be represented to different scales.

DETAILED DESCRIPTION

Figure 1:
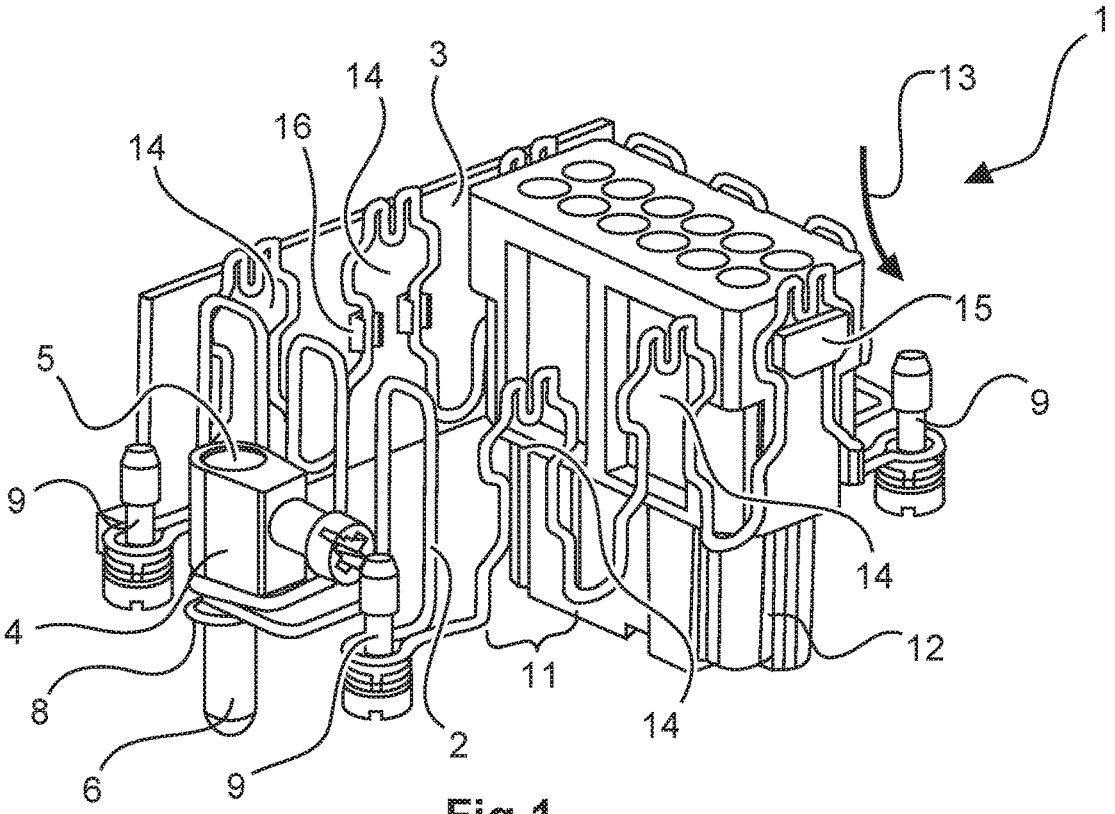
FIG. 1 shows a perspective representation of a holding frame according to a first embodiment of the invention, with one sidewall missing.
Figure 2:
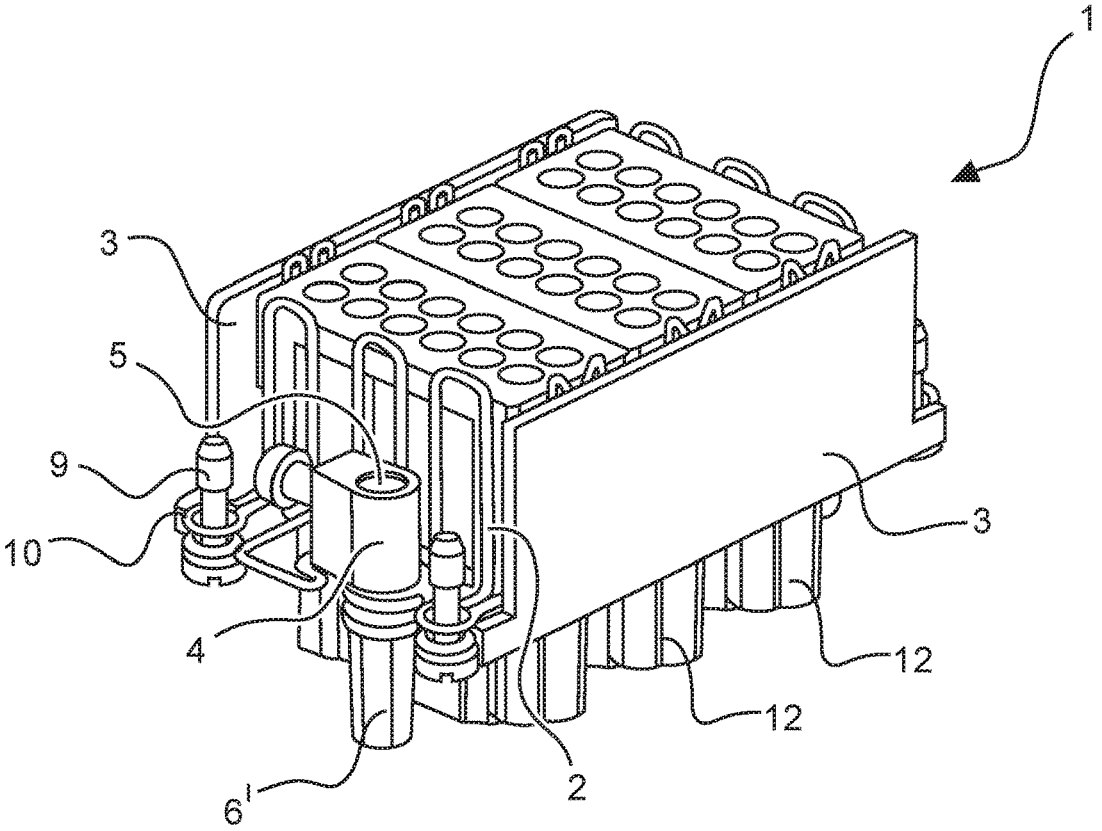
FIG. 2 shows a perspective representation of the holding frame according to the first embodiment of the invention, with both sidewalls.
Figure 4:
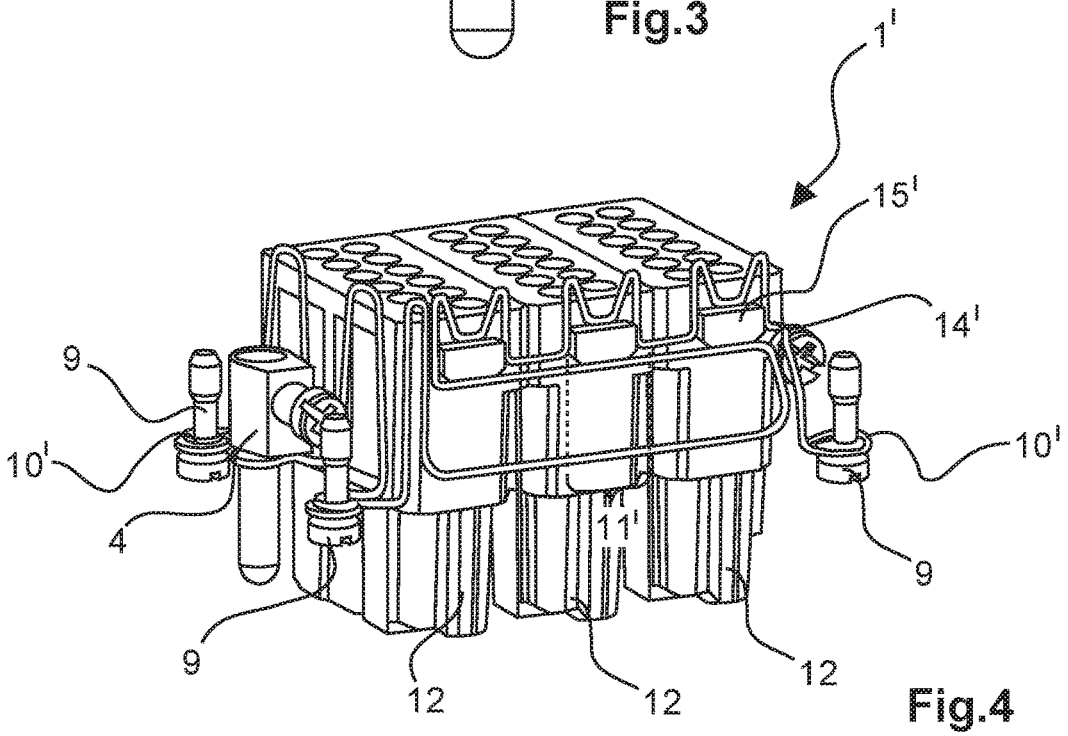
FIG. 4 shows a perspective representation of a second embodiment of a holding frame according to the invention.
Figure 5:
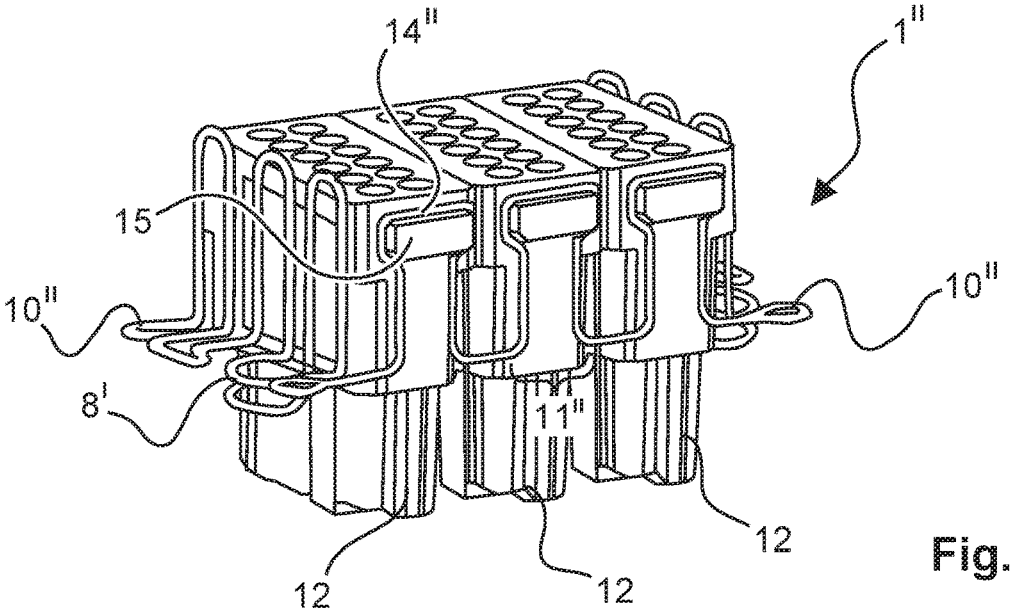
FIG. 5 shows a perspective representation of a third embodiment of a holding frame according to the invention.

FIGS. 1 and 2 show a perspective representation of a first form of embodiment of a holding frame 1 according to the invention. FIG. 4 shows a second form of embodiment of a holding frame 1' and FIG. 5 shows a third form of embodiment of a holding frame 1" according to the invention.

With reference to FIGS. 1 and 2, the holding frame 1 is comprised of a three-dimensionally bent wire frame. The wire frame is formed by a single and continuous piece of wire 2 which, for example, has been trimmed to an appropriate length beforehand from a roll of wire. Using a bending machine, the piece of wire can be formed into virtually any desired three-dimensional shape.

The wire frame constitutes a frame-like base structure having two mutually opposing end regions or end faces and two mutually opposing lateral regions or lateral surfaces. Sidewalls 3 are attached to the respective lateral regions. In this case, the sidewalls are reversibly attached to the wire frame by clamp arms 16. On one end region, a wire loop is constituted, in which a PE-contact element 4 is captively held. The PE-contact element 4 comprises a screw terminal 5 for a grounding line (not represented) and a contact pin 6 for grounding contact with a mating connector (not represented). Alternatively, the PE-contact element 4, instead of with a contact pin 6 (FIG. 1) can also be fitted with a contact socket 6' (FIG. 2).

Figure 3:
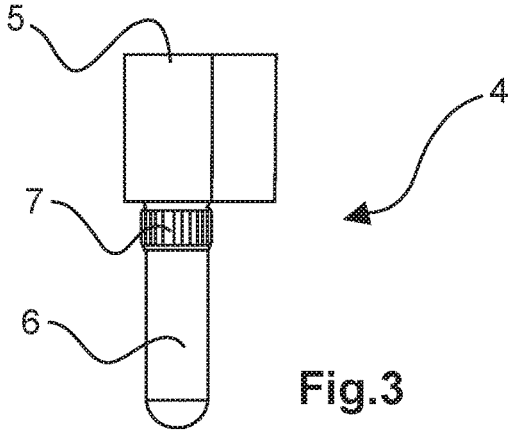
FIG. 3 shows a perspective representation of a PE-contact element.

Between the screw terminal 5 and the contact pin 6, the PE-contact element 4 incorporates a thickening 7, as shown in FIG. 3. The function of the thickening 7 is the fixing of the PE-contact element 4 in the wire loop 8 in the end region of the holding frame 1. The thickening 7 is optional and, for example, is not provided in the second variant of embodiment of the invention (FIG. 4).

In the corner regions of the holding frame 1, loops 10 are respectively constituted by the wire frame, in each of which screws 9 are held. By way of the screws 9, the holding frame 1 can be reversibly fastened in a housing of an industrial connector (not represented).

With reference to FIGS. 1, 2, 4 and 5, in the lateral regions, the holding frame 1, 1', 1", on both sides, comprises a plurality of fixing contours 11, 11', 11". In the exemplary embodiments, three such fixing contours 11, 11', 11" are shown for each lateral surface. However, fewer or more such fixing contours 11, 11', 11" can also be present.

In the exemplary embodiments, the holding frames 1, 1', 1", in the interests of simplicity, are respectively fitted with the same connector modules 12. Naturally, different connector modules, including in a combined form, can be fastened in the holding frame 1, 1', 1".

The connector modules 12 are generally inserted into the holding frame 1, 1', 1" from the direction of the closed end of the fixing contour 11, 11', 11" (i.e., the terminal side) in the direction of the arrow 13 of FIG. 1. The opposing fixing contours 11, 11', 11" of the connector module 12 are thus initially compressed outwards. Thereafter, by the action of the restoring force of the wire material, the fixing contours 11, 11', 11" are returned to their original position. The recesses 14, 14', 14" located at the end of the fixing contours 11, 11', 11" engage over the latching lugs 15 of the connector modules 12. The connector modules 12 are reversibly secured in the holding frame 1, 1', 1" accordingly.

In the forms of embodiment according to FIGS. 1, 2 and 5, there is also an option for the insertion of the connector modules 12 into the holding frame 1, 1', 1" from the plug-in side, i.e., conversely to the arrow 13 of FIG. 1. Likewise, the connector modules 12 can also be removed from the holding frame 1, 1', 1" from the plug-in side. If the connector modules 12 are inserted into the holding frame 1, 1" from the direction of the open end of the fixing contour (i.e., from the plug-in side, conversely to the arrow 13 of FIG. 1), the tapers of the respective fixing contour 11, 11" are initially expanded by the respective latching lugs 15 of the connector modules 12, until the latching lugs 15 are located in the respective recesses 14 of the fixing contours 11, 11". Thereafter, the taper is restored by the restoring force of the wire material, and the connector modules 12 are secured in the holding frame 1, 1". The connector modules 12 can be removed from the holding frame 1, 1", on the plug-in side (in the direction of the arrow 13 of FIG. 1), in an analogous manner. Optionally, to this end, the geometry of the respective recess 14, 14" of the fixing contour 11, 11" and of the latching lugs 15 of the connector modules 12 can be optimized in an expert fashion.

Although, in the figures, various aspects or characteristics of embodiments of the invention are respectively represented in combination, it will be evident to a person skilled in the art —unless otherwise indicated—that the combinations represented and discussed are not the only combinations possible. Specifically, mutually corresponding units or series of characteristics from different exemplary embodiments can be mutually interchanged. In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A holding frame for an industrial connector, for accommodating similar and/or different connector modules, wherein the holding frame comprises a three-dimensionally bent wire frame having a frame-like base structure having two mutually opposing end regions and two mutually opposing lateral regions to form a rectangular opening extending through the frame-like base structure to receive the connector modules.

2. The holding frame as claimed in claim 1, wherein the wire frame is constituted of a single and continuous piece of wire.

3. The holding frame as claimed in claim 1, wherein the wire frame is constituted of a piece of wire, a diameter of which is at least 1 millimeter, and up to 2 millimeters, in at least some regions of the wire frame.

4. The holding frame as claimed in claim 1, wherein each of a plurality of corner regions of the wire frame comprises a loop in which a respective fixing element is held for the reversible fastening of the holding frame in a connector housing.

5. The holding frame as claimed in claim 1, wherein the holding frame comprises two sidewalls, which are respectively attached to the lateral regions of the wire frame.

6. The holding frame as claimed in claim 1, wherein the holding frame comprises a PE-contact element.

7. The holding frame as claimed in claim 6, wherein the PE-contact element comprises a cylindrical contact pin, which incorporates a thickening.

8. The holding frame as claimed in claim 7, wherein the thickening assumes a knurled or a sprocket wheel-shaped surface.

9. The holding frame as claimed in claim 1, wherein the wire frame, at one of the end regions, incorporates a loop-shaped recess, in which a PE-contact element is held.

* * * * *